US008156607B2

(12) United States Patent
Chiang

(10) Patent No.: US 8,156,607 B2
(45) **Date of Patent: *Apr. 17, 2012**

(54) MOP WRINGER

(76) Inventor: Hsiao-Hung Chiang, Taipei (TW)

( * ) Notice: Subject to any disclaimer, the term of this patent is extended or adjusted under 35 U.S.C. 154(b) by 174 days.

This patent is subject to a terminal disclaimer.

(21) Appl. No.: 12/554,932

(22) Filed: Sep. 7, 2009

(65) Prior Publication Data

US 2010/0064469 A1 Mar. 18, 2010

Related U.S. Application Data

(62) Division of application No. 12/241,042, filed on Sep. 30, 2008, now Pat. No. 8,028,369.

(30) Foreign Application Priority Data

Sep. 17, 2008 (TW) ..... 97216771 U

(51) Int. Cl.
*A47L 13/00* (2006.01)

(52) U.S. Cl. ..... 15/260; 15/263; 15/119.1; 15/147.1

(58) Field of Classification Search ..... 15/260, 15/263; 34/58; *A47L 13/58*
See application file for complete search history.

(56) References Cited

U.S. PATENT DOCUMENTS

| | | | | |
|---|---|---|---|---|
| 6,454,143 | B1 * | 9/2002 | Young | 222/565 |
| 7,743,528 | B2 * | 6/2010 | Lin | 34/58 |
| 2007/0256527 | A1 * | 11/2007 | Phan | 81/475 |
| 2010/0077558 | A1 * | 4/2010 | Chiang | 15/119.1 |

* cited by examiner

*Primary Examiner* — Robert Scruggs

(57) ABSTRACT

A mop wringer includes a ratchet type mechanism so that a user may press a spring-biased foot step to wring strands of a mop swab disposed in a mop receptacle in a pail via gear connection, release the foot step to return to its initial condition, and repeatedly perform the above two steps until the mop swab is dried.

1 Claim, 4 Drawing Sheets

MOP WRINGER

CROSS REFERENCE TO RELATED APPLICATION

This application is a divisional application of U.S. application Ser. No. 12/241,042 filed Sep. 30, 2008 now U.S. Pat. No. 8,028,369, the contents of which are incorporated herein by reference.

BACKGROUND OF THE INVENTION

1. Field of Invention

The invention relates to floor cleaning equipment and more particularly to a mop wringer with improved characteristics.

2. Description of Related Art

There have been numerous suggestions in prior patents for mop wringer. For example, U.S. Pat. No. 5,349,720 discloses a mop wringer. Thus, continuing improvements in the mop wringer are constantly being sought.

SUMMARY OF THE INVENTION

It is therefore one object of the invention to provide a mop wringer. The above and other objects, features and advantages of the invention will become apparent from the following detailed description taken with the accompanying drawings.

DETAILED DESCRIPTION OF THE INVENTION

Figure 1:
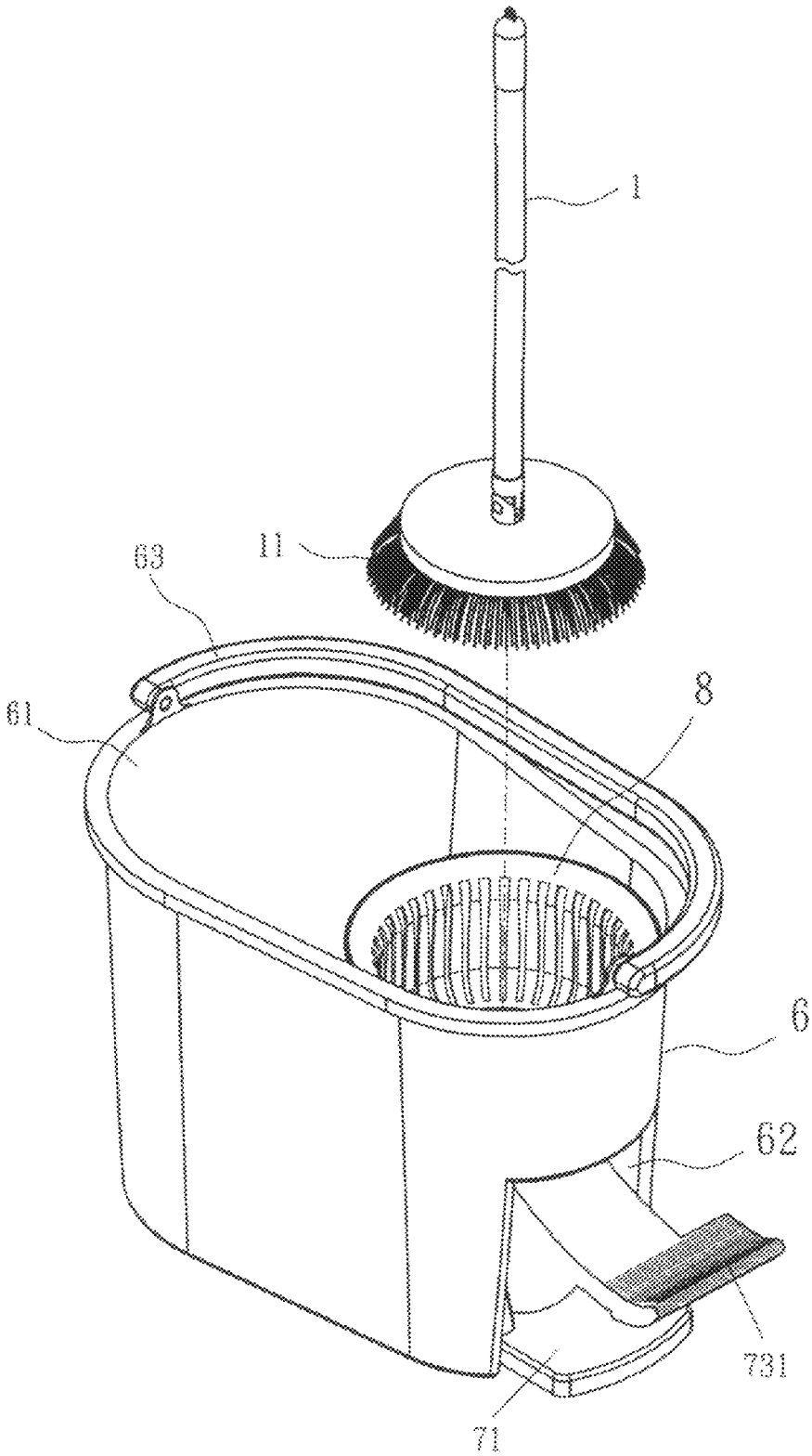
FIG. 1 is a perspective view of a mop wringer according to the invention.
Figure 2:
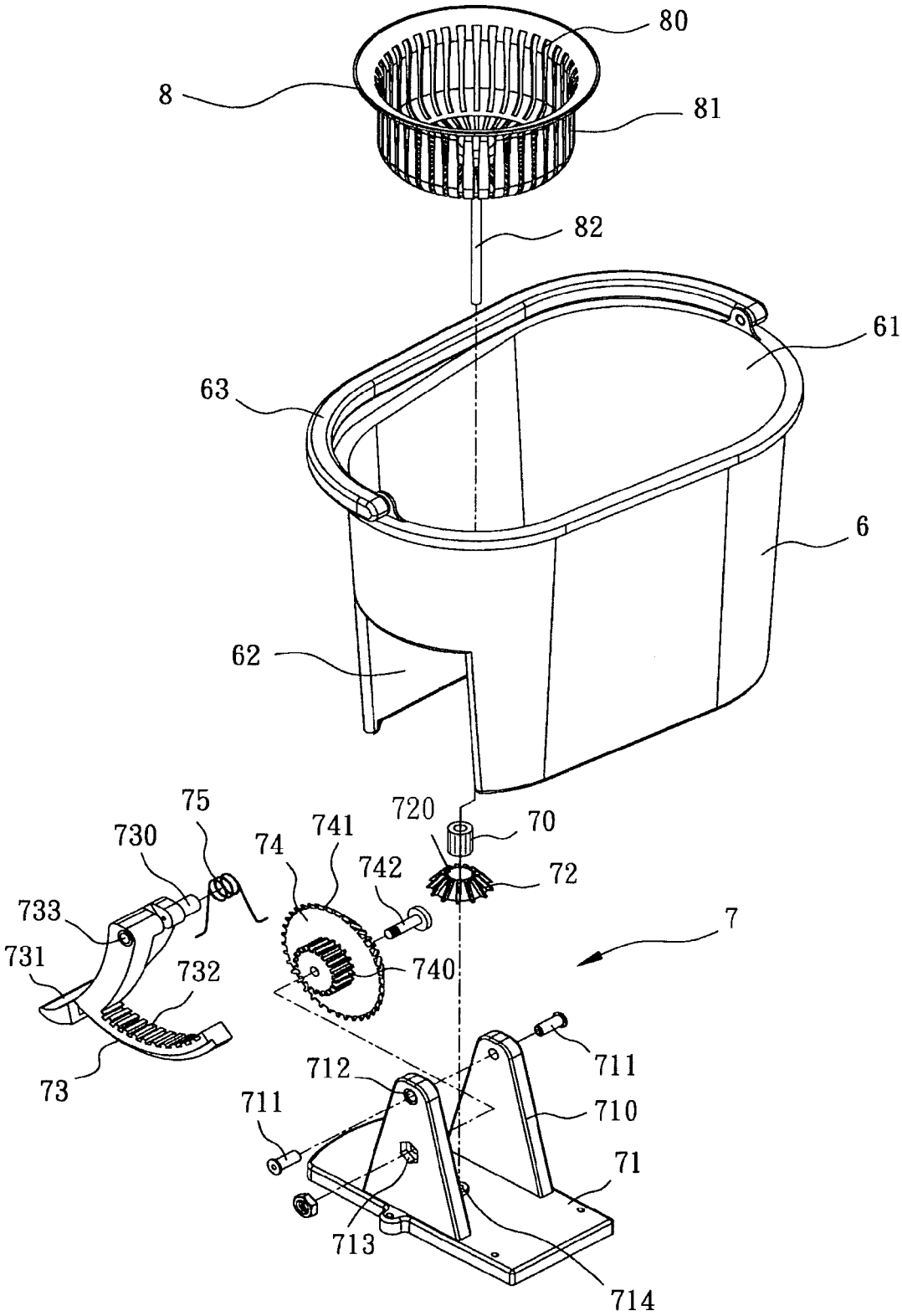
FIG. 2 is an exploded view of FIG. 1.
Figure 3:
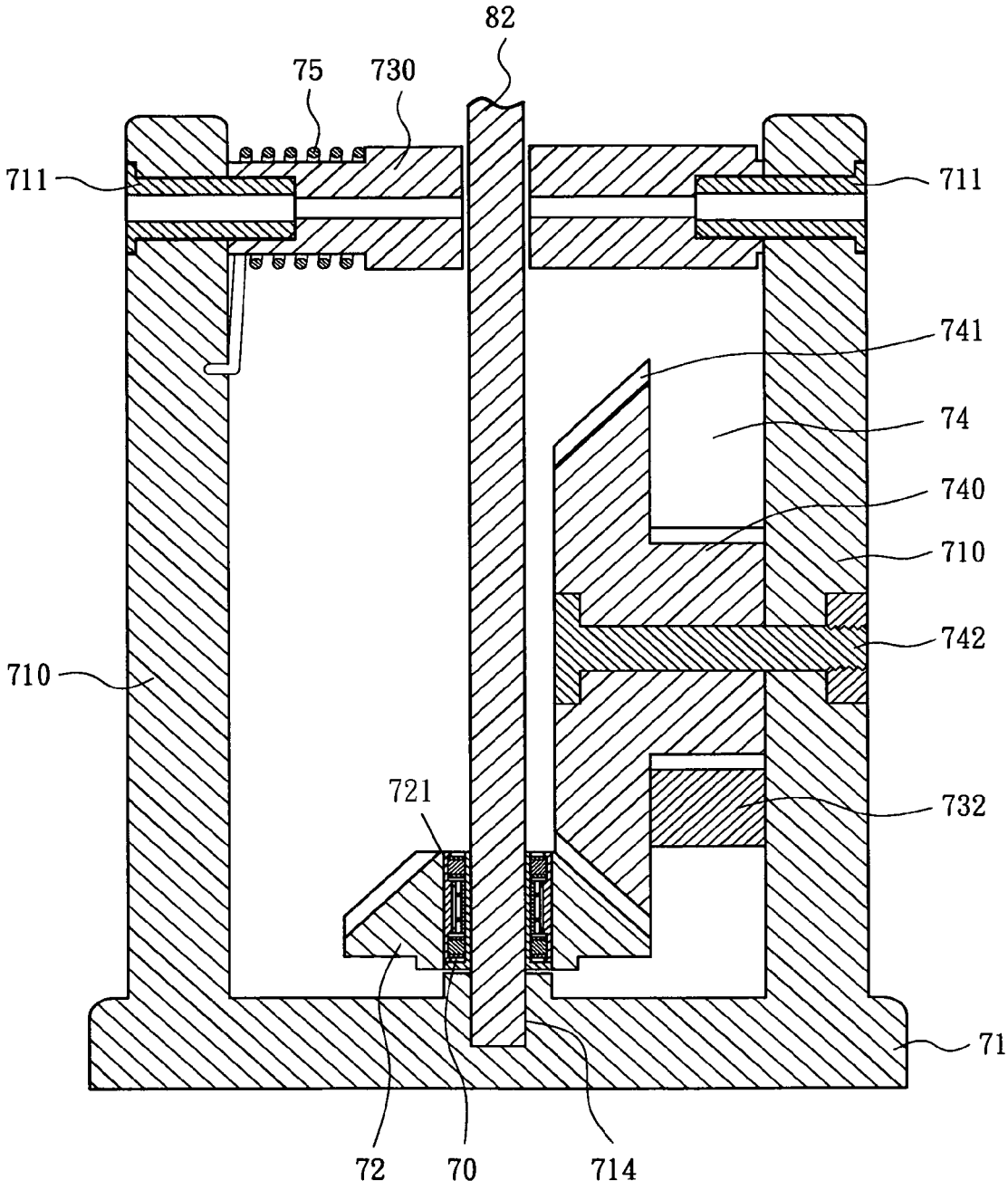
FIG. 3 is a longitudinal sectional view of the assembled actuation mechanism of FIG. 2.
Figure 4:
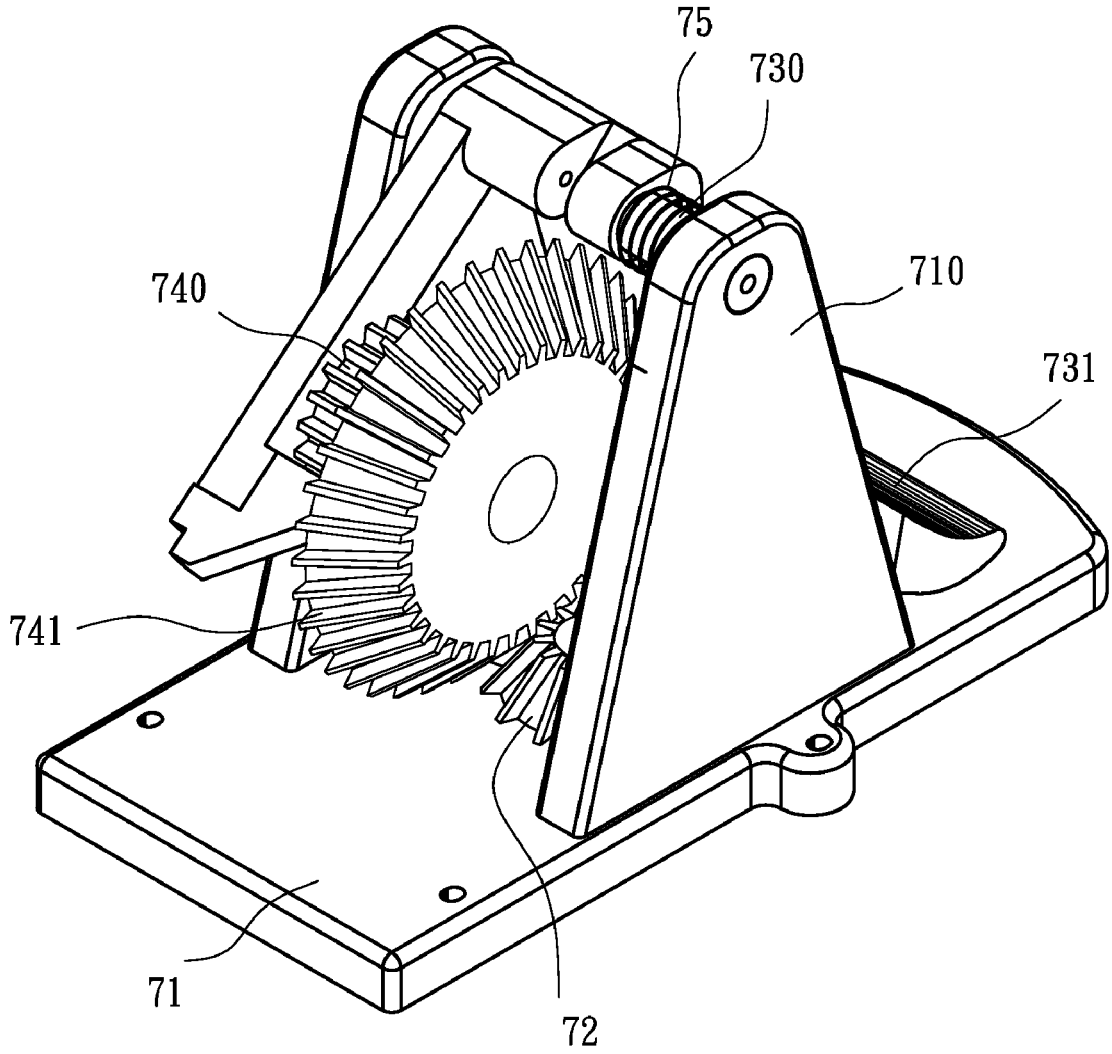
FIG. 4 is a perspective view of the actuation mechanism of FIG. 3.

Referring to FIGS. 1 to 4, a mop wringer in accordance with the invention is shown. The mop wringer comprises a pail 6 comprising a handle 63 hingedly provided on the top edge, an internal space 61, and a recess 62 on the peripheral wall.

The wringer further comprises a rotatable mop receptacle 8 disposed in the space 61. The mop receptacle 8 comprises a shell 81 having a flared open top, a tapered bottom, and a plurality of longitudinal holes 80, and a shaft 82 extending downward a predetermined length from the bottom center of the shell 81.

The wringer further comprises an actuation mechanism 7 comprising a substantially rectangular support 71 including a bossed hole 714 on the bottom and two substantially triangular upright mounts 710 on two sides respectively, each mount 710 having an upper hole 712 and one of the mounts 710 additionally having an intermediate hole 713 right below the hole 712.

The actuation mechanism 7 further comprises a pivot member 73 including an arcuate foot step 731 disposed in the recess 62 and extending out of the recess 62 a predetermined distance, an arcuate toothed member 732 provided opposing the foot step 731, a pivot shaft 730 provided above the toothed member 732, and a hole 733 provided opposing the pivot shaft 730; and a spring (e.g., torsion spring) 75 put on the pivot shaft 730. The spring 75 has one end urged against one mount 710 and the other end urged against the foot step 731. Further, two pins 711 are provided in which one pin 711 is inserted through one upper hole 712 into the hole 733, and the other pin 711 is inserted through the other upper hole 712 into the pivot shaft 730. As a result, the pivot member 73 and the support 71 are pivotably secured together.

The actuation mechanism 7 further comprises a gear assembly 74 including a small gearwheel 740 in mesh with the toothed member 732, a large first bevel gear 741 being coaxial and integral with the gearwheel 740, and a threaded fastener (e.g., bolt) 742 driven through both the gearwheel 740 and the first bevel gear 741 into the intermediate hole 713 to secure to a nut (not numbered); a small second bevel gear 72 meshed with the first bevel gear 741, the second bevel gear 72 having a longitudinal hole 720 with pawls 721 provided on the inner surface thereof; and a hollow, cylindrical ratchet member 70 provided in the longitudinal hole 720 of the second bevel gear 72 and being in ratchet engagement with the pawls 721.

The shaft 82 is inserted through an upper gap between the pivot shaft 730 and the hole 733 and the ratchet member 70 to rotatably anchor in the bossed hole 714 in which the shaft 82 is secured to the ratchet member 70 (i.e., they can co-rotate).

In a wringing operation, an operator may first dispose wet strands 11 of a mop 1 in the shell 81. Next, the operator may set one foot on the foot step 731 to press same by pivoting. Hence, the toothed member 732 rotates counterclockwise. And in turn, the gearwheel 740, the first bevel gear 741, the second bevel gear 72, the ratchet member 70, and the shaft 82 rotate with elastic force being stored in the spring 75. Hence, both the shell 81 and the strands 11 rotate counterclockwise in high speed. As a result, water in the strands 11 leaves the shell 81 via the holes 80 due to strong centrifugal force.

The spring 75 immediately releases its stored elastic energy after leaving the foot out of the foot step 731. Hence, the toothed member 732 rotates clockwise. And in turn, the gearwheel 740, the first bevel gear 741, and the second bevel gear 72 rotate in an opposite direction. But the ratchet member 70 does not rotate because it is not driven by the second bevel gear 72 due to the ratchet disengagement therewith. That is, the shaft 82 remains motionless. This can prevent both the shell 81 and the strands 11 from rotating clockwise. Finally, the foot step 731 returns to its initial condition. The operator may repeat the above steps until the strands 11 are sufficiently wrung.

While the invention herein disclosed has been described by means of specific embodiments, numerous modifications and variations could be made thereto by those skilled in the art without departing from the scope and spirit of the invention set forth in the claims.

What is claimed is:

1. A mop wringer comprising:

a pail having a recess on a peripheral wall;

a rotatable mop receptacle disposed in the pail, the mop receptacle comprising a plurality of longitudinal holes and a downward extending shaft; and an actuation mechanism comprising a support, a spring-biased pivot member pivotably secured to the support and comprising a foot step disposed in the recess and extending out of the recess a predetermined distance, and an arcuate toothed member opposite the foot step, the arcuate toothed member having an arcuate arrangement of teeth, a gear assembly rotatably secured to the support and comprising a gearwheel meshed with the arcuate arrangement of teeth of the arcuate toothed member, a first bevel gear being coaxial with the gear wheel, a second bevel gear meshed with the first bevel gear, the second bevel gear having a longitudinal hole with pawls disposed on a surface of the longitudinal hole, a rotational axis of the first bevel gear being non-parallel to a rotational axis of the second bevel gear, and a ratchet member disposed in the longitudinal hole of the second bevel gear and being in ratchet engagement with the pawls, wherein the shaft is inserted through the ratchet member to rotatably anchor on the bottom of the support.

* * * * *